US007711287B2

(12) United States Patent
Kimizuka et al.

(10) Patent No.: US 7,711,287 B2
(45) Date of Patent: May 4, 2010

(54) CARTRIDGE AND ELECTROPHOTOGRAPHIC IMAGE FORMING APPARATUS

(75) Inventors: Eiichiro Kimizuka, Mishima (JP); Masayuki Fukuda, Mishima (JP); Shigeo Miyabe, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 106 days.

(21) Appl. No.: 12/119,052

(22) Filed: May 12, 2008

(65) Prior Publication Data

US 2008/0286004 A1 Nov. 20, 2008

(30) Foreign Application Priority Data

May 15, 2007 (JP) ..... 2007-128987
Apr. 23, 2008 (JP) ..... 2008-112003

(51) Int. Cl.
*G03G 21/18* (2006.01)
*G03G 15/08* (2006.01)

(52) U.S. Cl. ..... 399/111; 399/119

(58) Field of Classification Search ..... 399/111, 399/119, 110, 107; 347/138, 152
See application file for complete search history.

(56) References Cited

U.S. PATENT DOCUMENTS 5,331,373 A 7/1994 Nomura et al. ..... 399/111
5,452,056 A 9/1995 Nomura et al. ..... 399/111
5,463,446 A 10/1995 Watanabe et al. ..... 399/111
5,585,889 A 12/1996 Shishido et al. ..... 399/113
5,640,650 A 6/1997 Watanabe et al. ..... 399/117
5,839,028 A 11/1998 Nomura et al. ..... 399/109
5,873,012 A 2/1999 Miyabe et al. ..... 399/90
5,878,309 A 3/1999 Nomura et al. ..... 399/111
5,878,310 A 3/1999 Noda et al. ..... 399/117
5,926,666 A 7/1999 Miura et al. ..... 399/25
5,943,529 A 8/1999 Miyabe et al. ..... 399/111
5,946,531 A 8/1999 Miura et al. ..... 399/111
5,950,047 A 9/1999 Miyabe et al. ..... 399/111
5,966,567 A 10/1999 Matsuzaki et al. ..... 399/111
6,029,031 A 2/2000 Yokomori et al. ..... 399/109
6,064,843 A 5/2000 Isobe et al. ..... 399/111
6,072,968 A 6/2000 Nomura et al. ..... 399/113
6,128,452 A 10/2000 Miyabe et al. ..... 399/90
6,154,623 A 11/2000 Suzuki et al. ..... 399/111

(Continued)

FOREIGN PATENT DOCUMENTS

JP 2002-244531 8/2002

(Continued)

*Primary Examiner*—Sophia S Chen
(74) *Attorney, Agent, or Firm*—Fitzpatrick, Cella, Harper & Scinto

(57) ABSTRACT

A cartridge that can be accurately positioned and stably held with respect to a main body of an electrophotographic image forming apparatus without causing a deterioration in operability for mounting and detaching the cartridge from the apparatus main body even if a reduction in cost and a reduction in size of the apparatus main body are realized and an electrophotographic image forming apparatus including such cartridge. The cartridge is a drum cartridge that has an electrophotographic photosensitive drum and is detachably mountable to the apparatus main body. The drum cartridge has lock portions that lock on both side plates of the apparatus main body at both ends in a longitudinal direction of the drum cartridge such that the apparatus main body follows the drum cartridge mounted on the apparatus main body.

12 Claims, 13 Drawing Sheets

U.S. PATENT DOCUMENTS

| | | | | |
|---|---|---|---|---|
| 6,167,219 | A | 12/2000 | Miyamoto et al. | 399/90 |
| 6,173,140 | B1 | 1/2001 | Suzuki et al. | 399/113 |
| 6,215,969 | B1 | 4/2001 | Nomura et al. | 399/111 |
| 6,282,390 | B1 | 8/2001 | Miyabe et al. | 399/111 |
| 6,317,572 | B1 | 11/2001 | Miyabe et al. | 399/111 |
| 6,336,017 | B1 | 1/2002 | Miyamoto et al. | 399/116 |
| 6,351,620 | B1 | 2/2002 | Miyabe et al. | 399/111 |
| 6,415,121 | B1 | 7/2002 | Suzuki et al. | 399/111 |
| 6,438,327 | B1 | 8/2002 | Kimizuka et al. | 399/12 |
| 6,519,431 | B1 | 2/2003 | Toba et al. | 399/111 |
| 6,542,706 | B2 | 4/2003 | Toba et al. | 399/111 |
| 6,549,736 | B2 | 4/2003 | Miyabe et al. | 399/111 |
| 6,603,939 | B1 | 8/2003 | Toba et al. | 399/103 |
| 6,678,488 | B2 | 1/2004 | Toba et al. | 399/111 |
| 6,795,666 | B2 | 9/2004 | Miyabe et al. | 399/109 |
| 6,836,629 | B2 | 12/2004 | Miyabe et al. | 399/111 |
| 6,859,626 | B2 | 2/2005 | Kimizuka et al. | 399/12 |
| 6,931,226 | B2 | 8/2005 | Chadani et al. | 399/109 |
| 6,934,485 | B2 | 8/2005 | Miyabe et al. | 399/90 |
| 7,136,604 | B2 | 11/2006 | Chadani et al. | 399/90 |
| 7,149,457 | B2 | 12/2006 | Miyabe et al. | 399/114 |
| 7,155,141 | B2 | 12/2006 | Sato et al. | 399/114 |
| 7,158,736 | B2 | 1/2007 | Sato et al. | 399/111 |
| 7,164,875 | B2 | 1/2007 | Miyabe et al. | 399/111 |
| 7,184,690 | B2 | 2/2007 | Ueno et al. | 399/117 |
| 7,212,768 | B2 | 5/2007 | Numagami et al. | 399/111 |
| 7,224,925 | B2 | 5/2007 | Sato et al. | 399/263 |
| 7,248,810 | B2 | 7/2007 | Miyabe et al. | 399/90 |
| 7,315,710 | B2 | 1/2008 | Ueno et al. | 399/117 |
| 7,349,657 | B2 | 3/2008 | Sato et al. | 399/263 |
| 2006/0228127 | A1 | 10/2006 | Miyabe et al. | 399/90 |
| 2008/0025757 | A1 | 1/2008 | Sato et al. | 399/111 |
| 2008/0152388 | A1 | 6/2008 | Ueno et al. | 399/167 |
| 2008/0240773 | A1 | 10/2008 | Sato et al. | 399/106 |
| 2008/0260428 | A1 | 10/2008 | Ueno et al. | 399/167 |
| 2008/0286000 | A1 | 11/2008 | Kimizuka et al. | 399/111 |

FOREIGN PATENT DOCUMENTS

| | | | |
|---|---|---|---|
| JP | 2003-084647 | * | 3/2003 |

* cited by examiner

CARTRIDGE AND ELECTROPHOTOGRAPHIC IMAGE FORMING APPARATUS

BACKGROUND OF THE INVENTION

1. Field of the Invention

The present invention relates to a cartridge detachably mountable to a main body of an electrophotographic image forming apparatus and an electrophotographic image forming apparatus to which the cartridge is detachably mountable.

2. Related Background Art

Conventionally, as an electrophotographic image forming apparatus that can form a color image, there is known an electrophotographic image forming apparatus in which developer images of respective colors are sequentially formed on one photosensitive drum using a plurality of developing devices for different colors. In addition, as disclosed in Japanese Patent Application Laid-Open No. 2002-244531, there is known an electrophotographic image forming apparatus in which a photosensitive drum and respective developing devices are adapted as cartridges detachably mountable to a main body of an image forming apparatus. In the following description, a cartridge having the electrophotographic photosensitive drum is referred to as a drum cartridge and a cartridge having the developing device is referred to as a developing cartridge.

In the electrophotographic image forming apparatus disclosed in Japanese Patent Application Laid-Open No. 2002-244531, a guide member is provided on an inner side of a right side plate and a left side plate of a main body frame of the apparatus main body. A mounting and detaching guide and a positioning portion for the cartridges are provided in the guide member. This allows the developing cartridge and the drum cartridge to be easily mounted and detached from the apparatus main body. Further, the cartridge can be accurately positioned with respect to the apparatus main body.

The main body frame and the guide member are required to accurately position the cartridges with respect to the apparatus main body and have rigidity for stably holding the cartridges.

In realizing a reduction in cost and a reduction in size of the apparatus main body, it is conceivable to reduce the thickness of the main body frame and the guide member provided on an inner side of the main body frame. However, in this case, the main body frame and the guide member tend to undergo a deflection. When the main body frame and the guide member undergo the deflection, it is likely that positioning accuracy deteriorates in positioning the cartridges with respect to the apparatus main body.

SUMMARY OF THE INVENTION

In view of the above-mentioned circumstances, it is an object of the present invention to provide a cartridge that can be accurately positioned with respect to an apparatus main body even if a reduction in cost of the apparatus main body is realized and an electrophotographic image forming apparatus including the cartridge.

It is another object of the present invention to provide a cartridge that can be accurately positioned with respect to an apparatus main body even if a reduction in size of the apparatus main body is realized and an electrophotographic image forming apparatus including the cartridge.

It is still another object of the present invention to provide a cartridge that can be accurately positioned with respect to an apparatus main body even if a thickness of a main body frame for supporting the cartridge, which is provided in the apparatus main body, is reduced and an electrophotographic image forming apparatus including the cartridge.

It is still another object of the present invention to provide a cartridge that can be accurately positioned with respect to an apparatus main body even if a reduction in cost and a reduction in size of the apparatus main body are realized by reducing a thickness of a main body frame for supporting the cartridge, which is provided in the apparatus main body, and an electrophotographic image forming apparatus including the cartridge.

It is still another object of the present invention to provide a cartridge that can be accurately positioned with respect to an apparatus main body by regulating a distance between sides of a main body frame by the cartridge even if the main body frame that undergoes a deflection is used and an electrophotographic image forming apparatus including the cartridge.

According to a representative structure of the present invention, in order to achieve the above-mentioned objects, an electrophotographic image forming apparatus that is detachably mounted with a cartridge and forms an image on a recording medium includes: one end side main body frame that supports one end side in a longitudinal direction of the cartridge mounted on the electrophotographic image forming apparatus, the one end side main body frame undergoing a deflection in the longitudinal direction; the other end side main body frame that supports the other end side in the longitudinal direction of the cartridge mounted on the electrophotographic image forming apparatus, the other end side main body frame undergoing a deflection in the longitudinal direction; and the cartridge that regulates a distance between the one end side main body frame and the other end side main body frame with the one end side in the longitudinal direction thereof supported by the one end side main body frame and the other end side in the longitudinal direction thereof supported by the other end side main body frame.

Also, according to another representative structure of the present invention, in order to achieve the above-mentioned objects, a cartridge is detachably mountable to a main body of an electrophotographic image forming apparatus that is detachably mounted with the cartridge and forms an image on a recording medium, the electrophotographic image forming apparatus having: one end side main body frame that supports one end side in a longitudinal direction of the cartridge mounted on the main body, the one end side main body frame undergoing a deflection in the longitudinal direction; and the other end side main body frame that supports the other end side in the longitudinal direction of the cartridge mounted on the main body, the other end side main body frame undergoing a deflection in the longitudinal direction, the cartridge including: a frame; one end side lock portion provided on one end side in a longitudinal direction of the frame; and the other end side lock portion provided on the other end side in the longitudinal direction of the frame, wherein the cartridge regulates a distance between the one end side main body frame and the other end side main body frame with the one end side in the longitudinal direction thereof supported by the one end side main body frame and the other end side in the longitudinal direction thereof supported by the other end side main body frame.

The present invention can provide a cartridge that can be accurately positioned with respect to an apparatus main body even if a reduction in cost of the apparatus main body is realized and an electrophotographic image forming apparatus including the cartridge.

The present invention can also provide a cartridge that can be accurately positioned with respect to an apparatus main body even if a reduction in size of the apparatus main body is realized and an electrophotographic image forming apparatus including the cartridge.

The present invention can further provide a cartridge that can be accurately positioned with respect to an apparatus main body even if a thickness of a main body frame for supporting the cartridge, which is provided in the apparatus main body, is reduced and an electrophotographic image forming apparatus including the cartridge.

The present invention can further provide a cartridge that can be accurately positioned with respect to an apparatus main body even if a reduction in cost and a reduction in size of the apparatus main body are realized by reducing a thickness of a main body frame for supporting the cartridge, which is provided in the apparatus main body, and an electrophotographic image forming apparatus including the cartridge.

The present invention can further provide a cartridge that can be accurately positioned with respect to an apparatus main body by regulating a distance between sides of a main body frame by the cartridge even if the main body frame that undergoes a deflection is used and an electrophotographic image forming apparatus including the cartridge.

Further features of the present invention will become apparent from the following description of exemplary embodiments with reference to the attached drawings.

DESCRIPTION OF THE EMBODIMENTS

Exemplary embodiments of the present invention will be hereinafter described with reference to the accompanying drawings. Dimensions, materials, shapes, a relative arrangement thereof, and the like of components described in embodiments described below should be appropriately modified according to the structure and various conditions of an apparatus and a cartridge to which the present invention is applied. Therefore, unless specifically described otherwise, the scope of the present invention is not meant to be limited only to the dimensions, the materials, the shapes, the relative arrangement thereof, and the like.

First Embodiment

Figure 1:
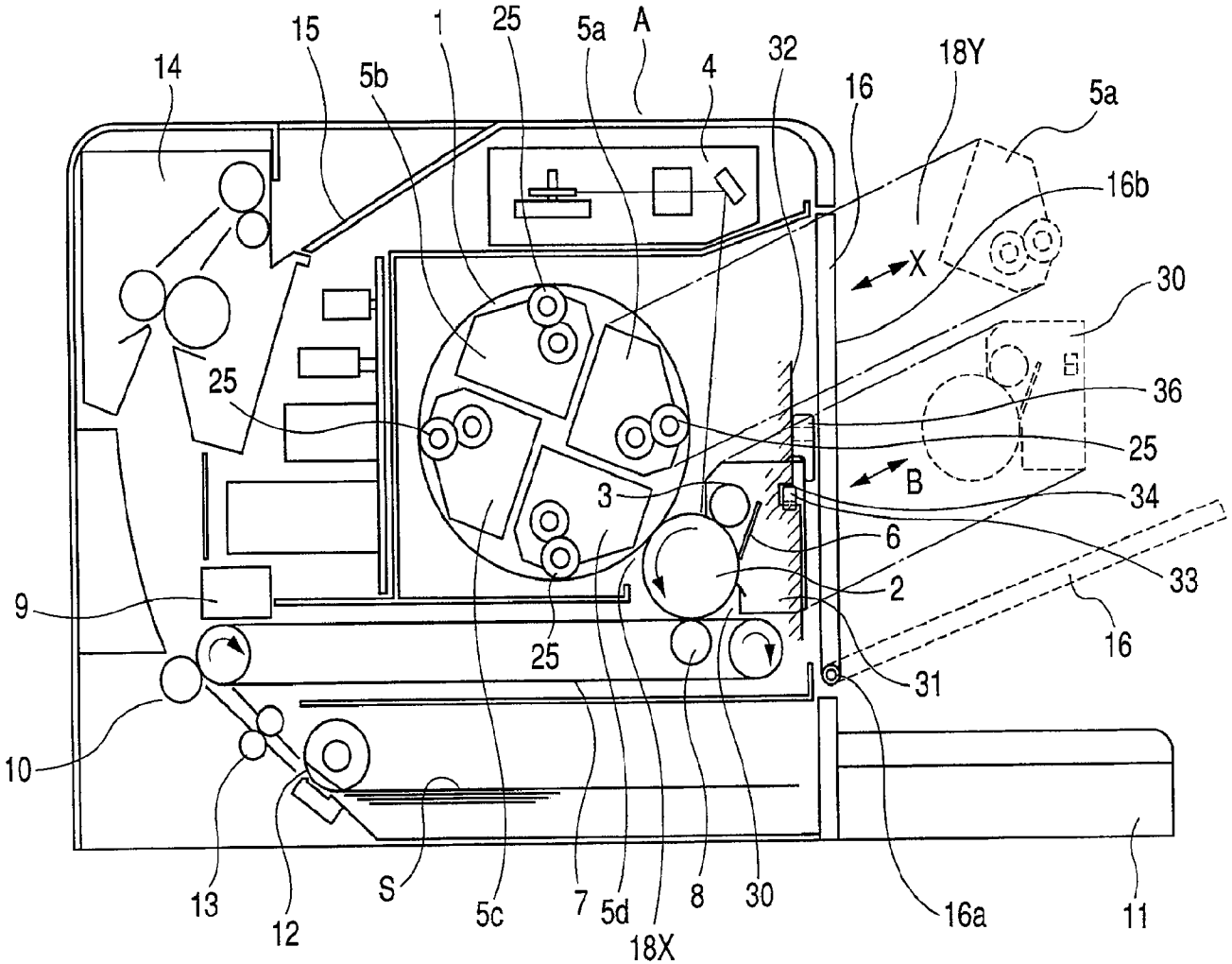
FIG. 1 is a sectional view of the schematic structure of a laser beam printer as an example of an electrophotographic image forming apparatus.
Figure 2:
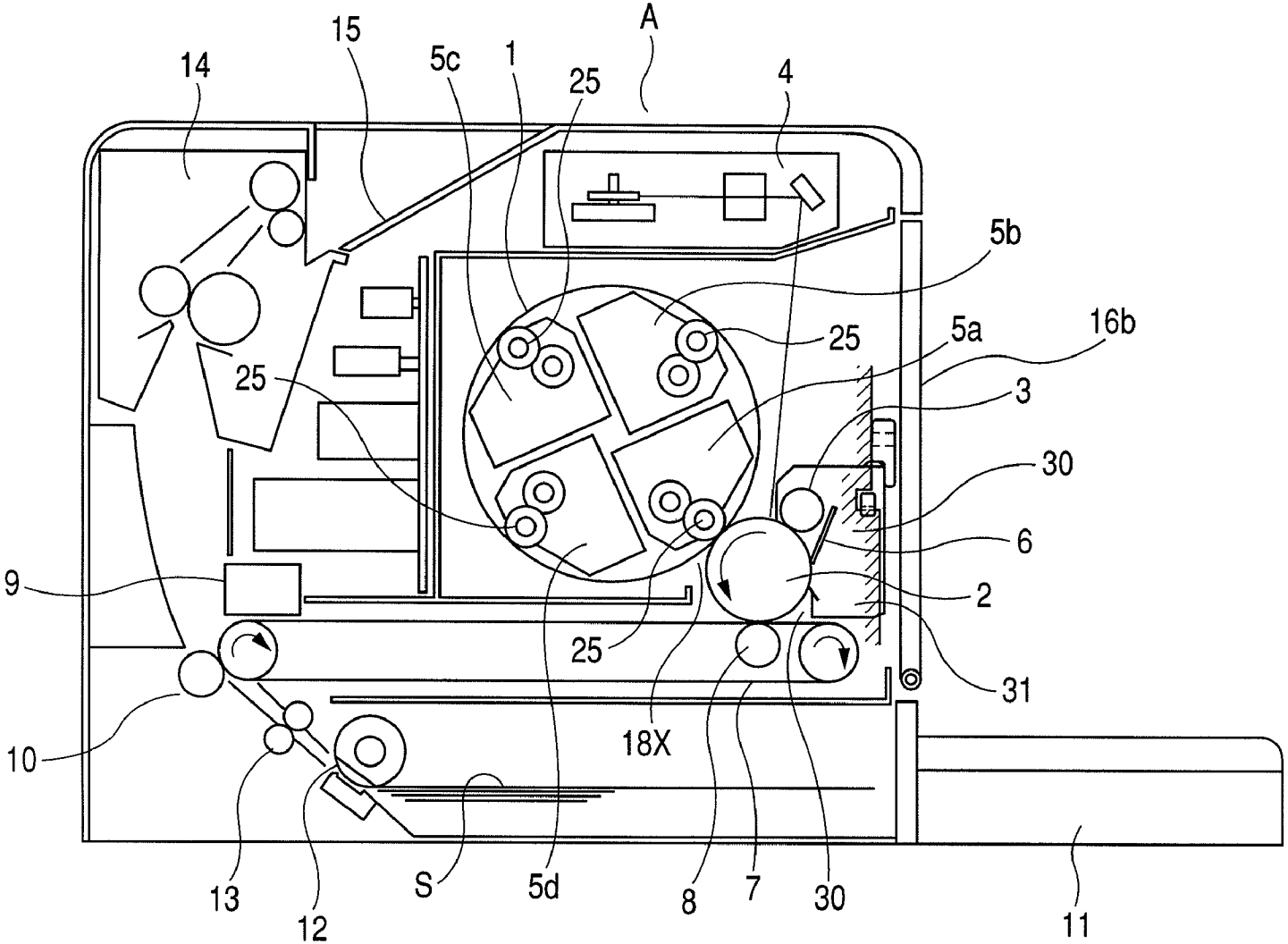
FIG. 2 is another sectional view of the schematic structure of the laser beam printer as an example of the electrophotographic image forming apparatus.

A first embodiment of the present invention is described. In the first embodiment, as an electrophotographic image forming apparatus, a color laser beam printer including one photosensitive drum and four developing devices is described as an example. FIGS. 1 and 2 are sectional views of the schematic structures of the color laser beam printer.

First, an image forming operation of the color laser beam printer is described. In the embodiments described below, the electrophotographic image forming apparatus is detachably mounted with cartridges (developing cartridges 5 and a process cartridge 30) and forms an image on a recording medium S. As illustrated in FIGS. 1 and 2, the electrophotographic image forming apparatus (hereinafter referred to as image forming apparatus) has an electrophotographic photosensitive drum 2. A plurality of (four) developing devices (developing cartridges) 5 (5*a*, 5*b*, 5*c*, 5*d*) are arranged around the photosensitive drum 2. A charging roller 3 and a cleaning device 6 as process means that act on the photosensitive drum 2 are also arranged. Further, an exposure device 4 is also arranged. The charging roller 3 is charging means for uniformly charging the photosensitive drum 2. The exposure device 4 is exposing means for irradiating the photosensitive drum 2 with a laser beam corresponding to image information and forming an electrostatic latent image on the photosensitive drum 2. The developing devices 5 (5*a* to 5*d*) are developing means for developing the latent image, which is formed on the photosensitive drum 2, with developers of colors (yellow, magenta, cyan, and black) corresponding to the developing devices 5 (5*a* to 5*d*) and visualizing the latent image. The developing device 5*a* contains the yellow developer and develops the latent image with the yellow developer. The developing device 5*b* contains the magenta developer and develops the latent image with the magenta developer. The developing device 5*c* contains the cyan developer and develops the latent image with the cyan developer. The developing device 5*d* contains the black developer and develops the latent image with the black developer. In other words, the developing devices 5 (5*a* to 5*d*) develop the electrostatic latent image, which is formed on the photosensitive drum 2, with the developers. It should be noted that the developing devices 5 (5*a* to 5*d*) have developing rollers 25 and develop the latent image using the developing rollers 25. The cleaning device 6 is cleaning means for removing a residual developer remaining on the photosensitive drum 2.

The photosensitive drum 2 and the developing devices 5 (5*a* to 5*d*) are adapted as cartridges detachably mountable to a main body of an image forming apparatus A, respectively. In other words, the photosensitive drum 2 is provided in the process cartridge 30 detachably mountable to the apparatus main body A. In addition, the respective developing devices 5 (5*a* to 5*d*) are the developing cartridges 5 (5*a* to 5*d*) detachably mountable to the apparatus main body A. The respective cartridges are detachably mountable to the apparatus main body A independently from one another by an operator (user). In this embodiment, the cartridge 30 includes, besides the photosensitive drum 2, the charging roller (charging means) 3, the cleaning device (cleaning means) 6, and a residual-developer containing portion 31 that contains a residual developer removed by the cleaning device 6. In addition, the respective cartridges 5 (5*a* to 5*d*) are detachably mountable to a rotary (rotary supporting member) 1 provided in the apparatus main body A.

It should be noted that a process cartridge is a cartridge formed by integrating, for example, an electrophotographic photosensitive member and at least one of developing means, charging means, and cleaning means serving as the process means. Therefore, examples of the process cartridge include: a cartridge formed by integrating the electrophotographic photosensitive member and the developing means, the charging means, and the cleaning means serving as the process means; a cartridge formed by integrating the electrophotographic photosensitive member and the charging means serving as the process means; and a cartridge formed by integrating the electrophotographic photosensitive member and the charging means and the cleaning means serving as the process means.

The user can mount and detach the process cartridge and the developing cartridges from the apparatus main body. Therefore, the user can maintain the image forming apparatus without relying on a serviceperson. Consequently, maintainability of the image forming apparatus is improved.

The photosensitive drum 2 is rotated in an arrow direction (of FIG. 2, counterclockwise) in synchronization with the rotation of an intermediate transfer belt 7. The surface of the photosensitive drum 2 is uniformly charged by the charging roller 3. Simultaneously with the charging, light for the yellow image irradiates the photosensitive drum 2 by the exposure device 4. Consequently, a yellow electrostatic latent image is formed on the photosensitive drum 2.

Simultaneously with the latent image formation, the rotary (rotary supporting member) 1 that supports the four developing cartridges 5*a* to 5*d* is rotated. Then, the developing cartridge 5*a* containing the yellow developer is arranged in a developing position 18X opposed to the photosensitive drum 2. Then, a voltage having substantially the same polarity as a charging polarity of the photosensitive drum 2 and a potential substantially same as a potential of the photosensitive drum 2 is applied to the developing roller 25 to cause the yellow developer to adhere to the latent image formed on the photosensitive drum 2. Consequently, the yellow developer is caused to adhere to the latent image to develop the latent image. In other words, the developing roller 25 develops the latent image.

Thereafter, a voltage having a polarity opposite to a polarity of the developer is applied to a primary transfer roller 8 arranged on an inner side of the transfer belt 7. Consequently, the yellow developer image formed on the photosensitive drum 2 is primarily transferred onto the transfer belt 7.

When the primary transfer of the yellow developer image is finished as described above, the developing cartridges 5*b* to 5*d* for the respective colors of magenta, cyan, and black are sequentially rotated and moved by the rotary 1. Then, the developing cartridges 5*b* to 5*d* are positioned in a developing position 18X opposed to the photosensitive drum 2. Consequently, as in the case of yellow, the formation, the development, and the primary transfer of latent images are sequentially performed for the respective colors of magenta, cyan, and black. Then, four developer images are superimposed one on top of another on the transfer belt 7.

While the developer images are formed and primarily transferred onto the transfer belt 7, a secondary transfer roller 10 is not in contact with the transfer belt 7. In addition, a cleaning unit 9 that removes a residual developer remaining on the transfer belt 7 is not in contact with the transfer belt 7 either.

On the other hand, sheets S as recording media are stored in a cassette 11 provided in a lower part of the image forming apparatus. The sheets S are separated and fed from the cassette 11 one by one by a sheet feeding roller 12 and fed to a registration roller pair 13. The registration roller pair 13 forwards the fed sheet S to between the transfer belt 7 and the transfer roller 10. At this time, the transfer roller 10 is in press contact with the transfer belt 7 (state illustrated in FIG. 2). It should be noted that the recording media are media on which images are formed, for example, paper and an OHP sheet.

A voltage having a polarity opposite to the polarity of the developer is applied to the transfer roller 10. And, the four-color developer images superimposed one on top of another on the transfer belt 7 are collectively transferred (secondarily transferred) onto the surface of the conveyed sheet S.

The sheet S having the developer images transferred thereon is sent to a fixing device 14. The sheet S is heated and pressed in the fixing device 14. Then, the developer images are fixed on the sheet S. Consequently, an image is formed on the sheet S. After that, the sheet S is discharged from the fixing device 14 to a discharge portion of an upper cover 15 in an upper part of the image forming apparatus.

An operation for mounting and detaching the developing cartridges 5*a* to 5*d* and the process cartridge 30 will be described with reference to FIG. 1.

The operation for mounting and detaching the developing cartridges is the same for all the developing cartridges 5*a* to 5*d*. Therefore, the operation for mounting and detaching the yellow developing cartridge 5*a* is described. When the cartridge 5*a* is taken out from the apparatus main body A, the cartridge 5*a* is rotated and moved by the rotary 1 to a mounting and detaching position 18Y (position illustrated in FIG. 1) different from the developing position 18X illustrated in FIG. 2. At this point, none of the developing cartridges 5 is present in the developing position 18X. When the cartridge 5*a* is mounted and detached in this state, the operator opens an open-closable cartridge door 16. This enables the operator to remove the cartridge 5*a* from the rotary 1 and take out the cartridge 5*a* from the apparatus main body A. It should be noted that the door 16 is pivotable with respect to the apparatus main body A around a fulcrum 16*a*. In FIG. 1, an open state of the door 16 is indicated by a broken line and a closed state of the door 16 is indicated by a solid line. The cartridge 5*a* is detachably mountable in an arrow X direction, and the taken-out cartridge 5*a* is indicated by a broken line. The mounting and detaching position 18Y is a position where the cartridge 5*a* is opposed to the door 16. In addition, the developing position 18X is a position where the cartridge 5*a* is opposed to the photosensitive drum 2.

Moreover, it is also possible to take out the process cartridge 30 from the apparatus main body A by opening the door 16 as described above (FIG. 1). It should be noted that the cartridge 30 is detachably mountable in an arrow B direction. The taken-out cartridge 30 is indicated by a broken line (FIG. 1).

In the structure described above, it is possible to mount and detach any cartridges 5*a* to 5*d* and 30 from the apparatus main body A independently from one another through one opening 16*b* of the apparatus main body A by opening the door 16.

Figure 3:
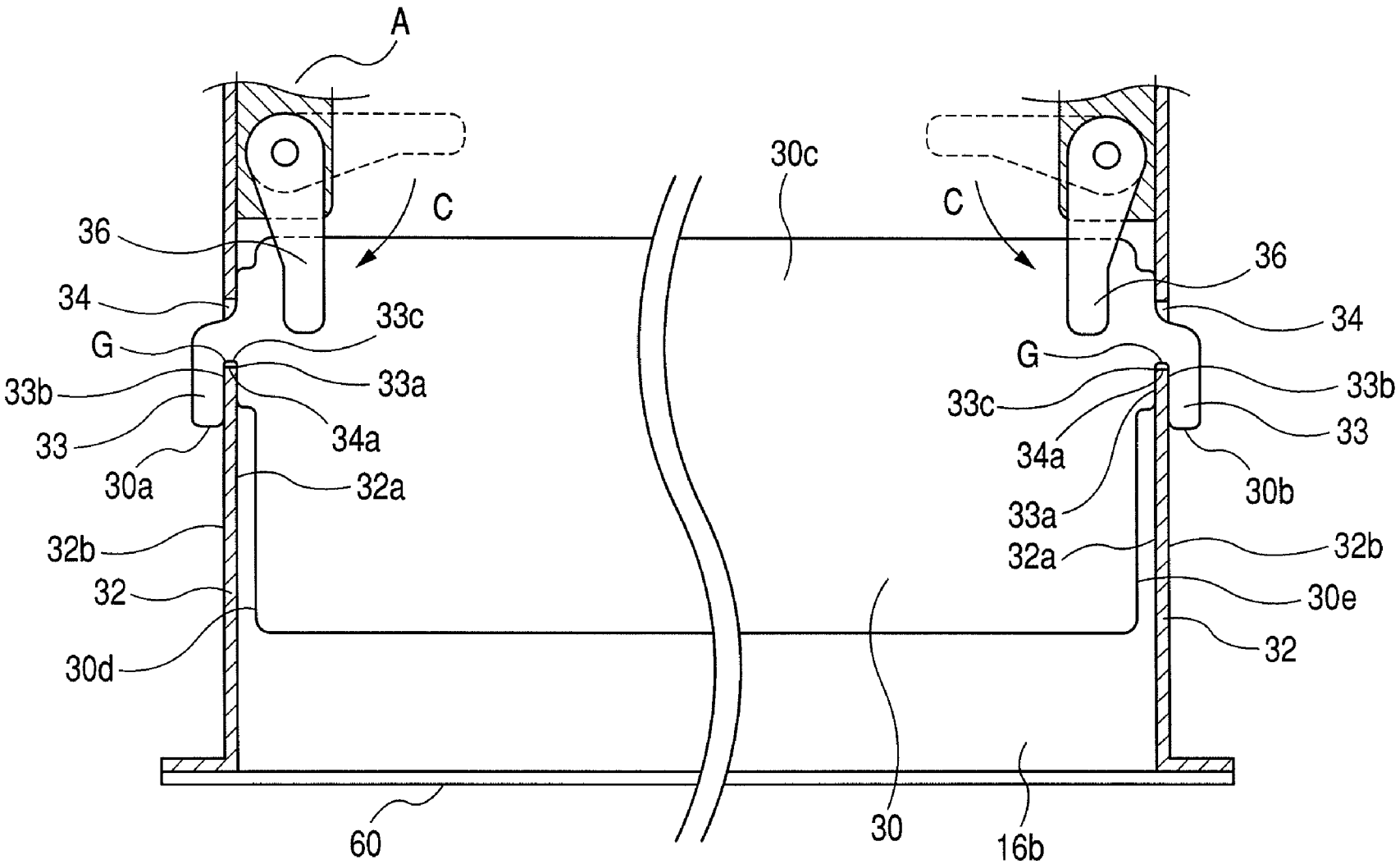
FIG. 3 is a front view of a state of a drum cartridge mounted on an apparatus main body according to a first embodiment of the present invention.
Figure 4:
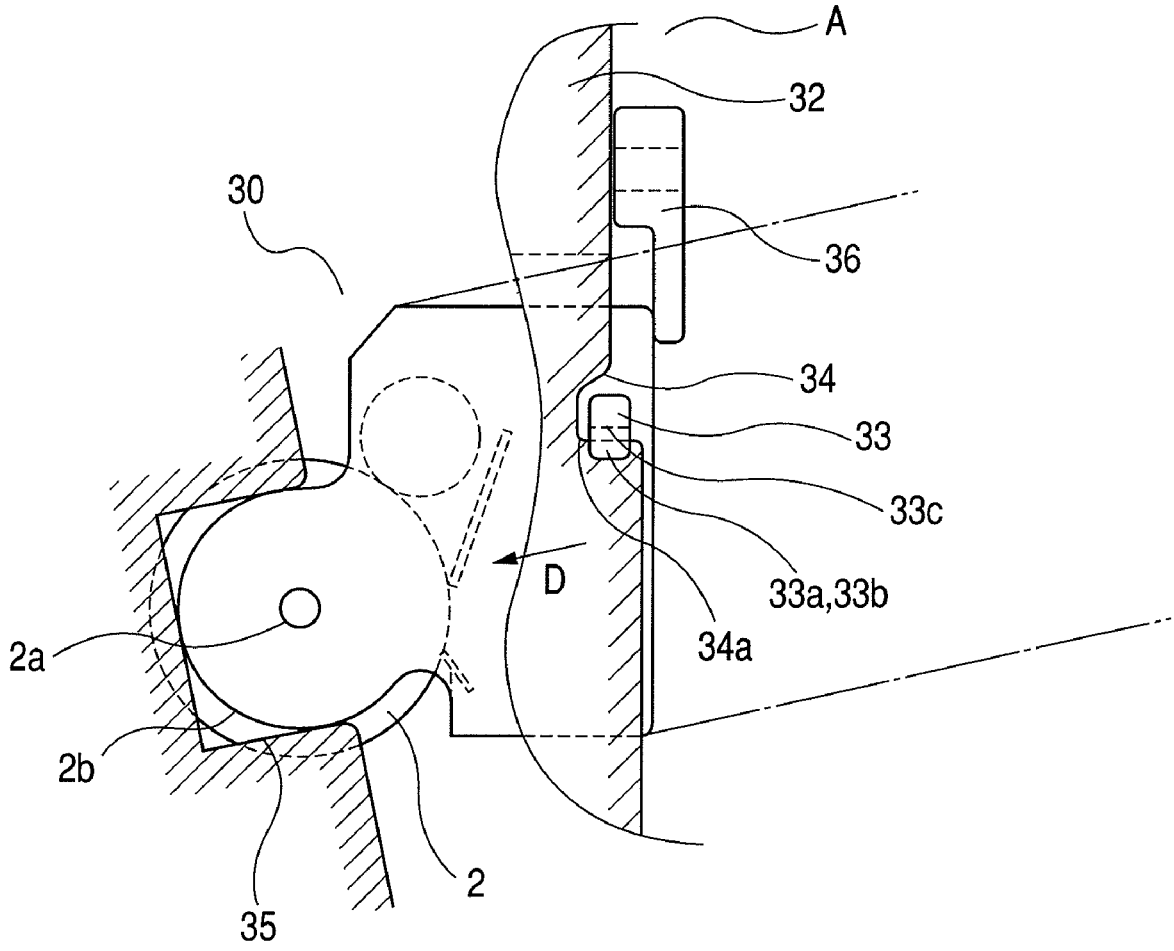
FIG. 4 is a sectional view of the state of the drum cartridge mounted on the apparatus main body according to the first embodiment.
Figure 8:
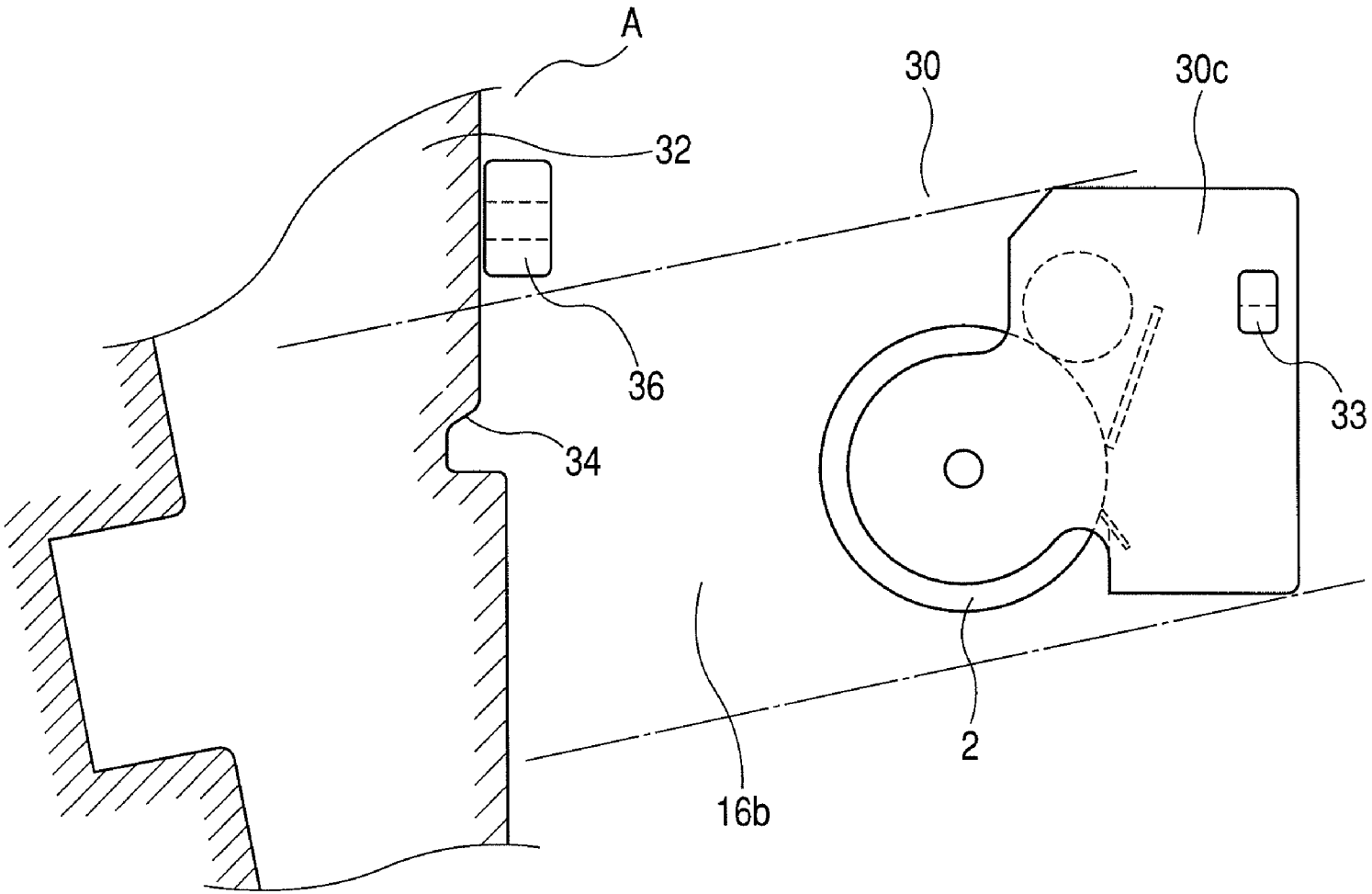
FIG. 8 is a sectional view of a state of mounting the drum cartridge on the apparatus main body according to the first embodiment.
Figure 9:
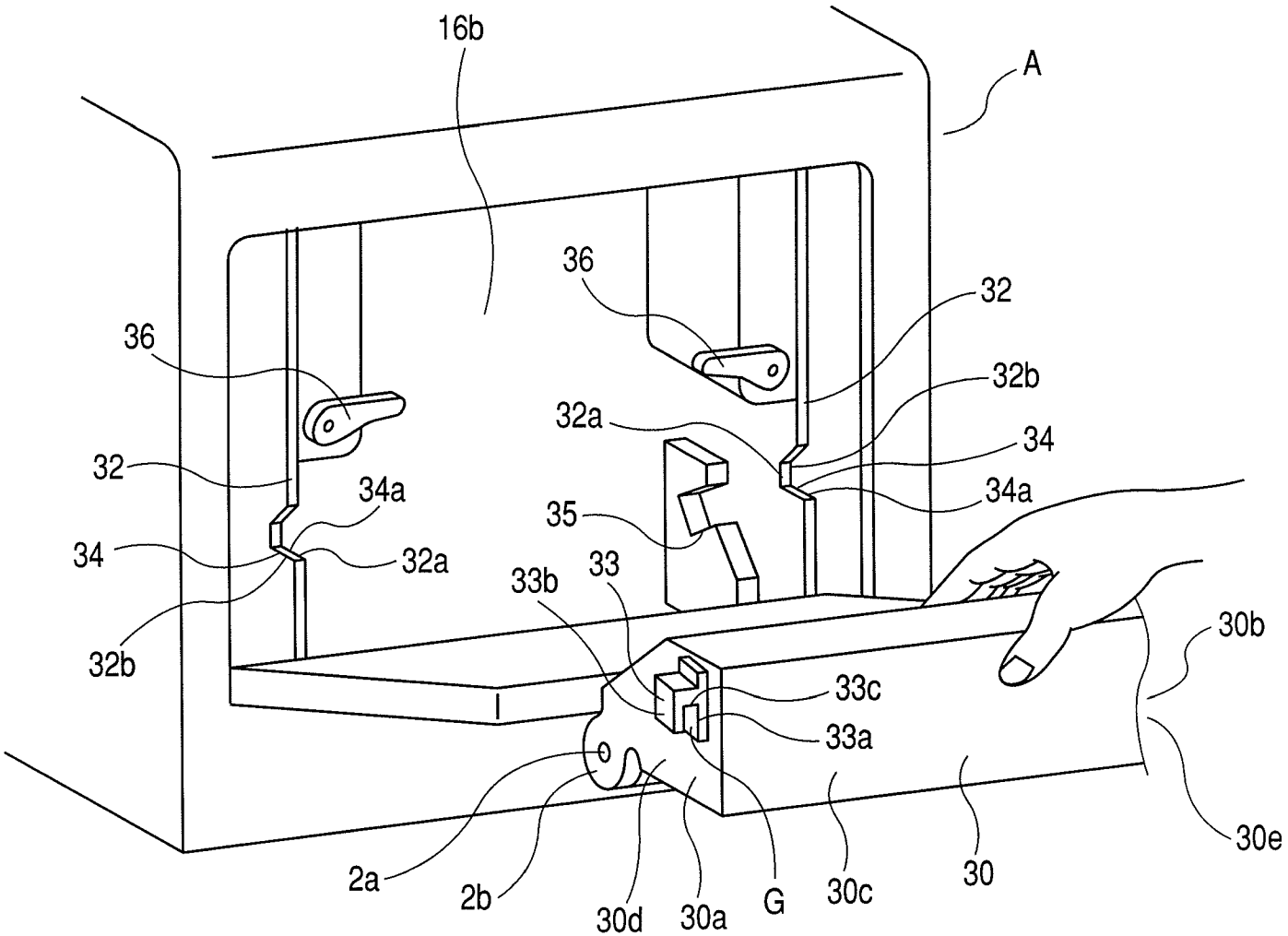
FIG. 9 is a perspective view of the state of mounting the drum cartridge on the apparatus main body according to the first embodiment.

A state of the cartridge 30 mounted on the apparatus main body A will be described with reference to FIGS. 3 and 4. FIG. 3 is a front view illustrating a state of the cartridge 30 mounted on the apparatus main body A. FIG. 4 is a sectional view illustrating the state of the cartridge 30 mounted on the apparatus main body A. It should be noted that FIG. 8 is a sectional view illustrating a state of mounting the cartridge 30 on the apparatus main body A. And, FIG. 9 is a perspective view illustrating the state of mounting the cartridge to the apparatus main body A.

As illustrated in FIG. 3, lock portions 33 that lock the cartridge 30 with the apparatus main body A when the cartridge 30 is mounted on the apparatus main body A are provided at both ends (one end 30*a* and the other end 30*b*) in a longitudinal direction of the cartridge 30. The lock portions 33 are integrally provided in a frame 30*c* of the cartridge 30. In other words, the lock portions 33 are provided on an outer surface of a side 30*d* provided at the one end 30*a* in the longitudinal direction of the frame 30*c* and an outer surface of a side 30*e* provided at the other end 30*b* in the longitudinal direction. The respective lock portions 33 are locked in cut-out portions 34, which are provided in both side plates (main body frame) 32 provided in the apparatus main body A, respectively, in the state of the cartridge 30 mounted on the apparatus main body A. In other words, the lock portions 33 have attached portions 33*a* attached to the sides (30*d* and 30*e*) and engaging portions 33*b* opposed to the attached portions 33*a* with gaps G therebetween. In addition, the lock portions 33 have supported portions 33*c* that connect the attached portions 33*a* and the engaging portions 33*b* with gaps therebetween. And, the lock portions 33 bilaterally constrain and lock the side plates 32 in the longitudinal direction. In other words, the lock portions 33 lock the side plates 32 with the side plates 32 constrained by the attached portions 33*a* and the engaging portions 33*b*. Specifically, the supported portions 33*c* are supported by upper edges 34*a* of the cut-out portions 34 of the side plates 32 with inner side portions 32*a* of the side plates 32 constrained by the attached portions 33*a* and with outer portions 32*b* of the side plates 32 constrained by the engaging portions 33*b* (FIGS. 3 and 9). In this state, the one end 30*a* of the cartridge 30 is supported by the side plate 32*a* on the one end side and the other end 30*b* of the cartridge 30 is supported by the side plate 32 on the other end side, whereby the cartridge 30 is detachably mounted on the apparatus main body A. In this state, the side plate 32 on the one end side and the side plate 32 on the other end side are locked following the cartridge 30 at both of the ends in the longitudinal direction of the cartridge 30.

In other words, when the side plates 32 undergo a deflection to the inner side of the apparatus main body A, the attached portions 33*a* urge the inner side portions 32*a* of the side plates 32 to the outside and the lock portions 33 lock to the side plates 32. And, when the side plates 32 undergo a deflection to the outer side of the apparatus main body A, the lock portions 33*b* urge the outer side portions 32*b* of the side plates 32 to the inside and the lock portions 33 lock to the side plates 32.

In this way, the cartridge 30 corrects the deflection of the side plates 32 and maintains a distance between both of the side plates 32. According to this embodiment described above, the one end side lock portion 33 provided on the one end side of the cartridge 30 bilaterally constrains and locks the one end side plate 32 in the longitudinal direction. And, the other end side lock portion 33 provided on the other end side of the cartridge 30 bilaterally constrains and locks the other end side plate 32 in the longitudinal direction.

Therefore, the cartridge 30 can ensure the distance between both of the side plates 32. In other words, the cartridge 30 can regulate the distance between both of the side plates 32. It should be noted that, specifically, the gaps G are set slightly larger than the thickness of the side plates 32, taking into account a manufacturing tolerance. In this embodiment, a material of the side plates 32 is zinc-coated steel or a material similar thereto. In addition, the thickness of the side plates 32 is about 0.6 mm. On the other hand, the gaps G are about 0.65 mm. It should be noted that the width of the side plates 32 is about 300 mm and the height of the side plates 32 is about 220 mm. In addition, the thickness of conventional side plates is 1.0 mm to 0.8 mm. According to this embodiment, the thickness of the side plates 32 can be set smaller than the thickness of the conventional side plates by about 0.2 mm. In other words, according to this embodiment, since the thickness is small, even if the side plates 32 tilt to the inner side or the outer side of the apparatus main body A, accuracy of the distance between both of the side plates 32 can be maintained by the cartridge 30. In addition, the cartridge 30 can achieve a function of reinforcing the side plates 32. It should be noted that the weight of the cartridge 30 used in this embodiment is about 500 g.

It should be noted that the present invention is not limited to this embodiment. The numerical values and the materials described above are only examples. Numerical values and materials can be selected as appropriate.

A bottom plate 60 connects the side plates 32 on a lower side. In other words, the side plates 32 are vertically (substantially vertically) attached to the bottom plate 60. A top plate (not shown) that connects an upper side of the side plates 32 is also provided.

This embodiment is effective when the side plates 32 undergo a deflection (cause positional deviation) even if, for example, the bottom plate, the top plate, or a stay (not shown) that connects both of the side plates 32 is provided.

According to this embodiment, the distance between both of the side plates 32 is regulated by the cartridge 30. Therefore, the frame 30*c* of the cartridge 30 according to this embodiment is made of polystyrene with the thickness of 1.5 mm to 2.5 mm Consequently, the cartridge 30 has sufficient rigidity. It should be noted that the rigidity of the frame 30*c* can be realized not only by the thickness but also by, for example, forming ribs in the frame 30*c* or by attaching a metal reinforcing member such as an iron plate to the frame 30*c*. Therefore, the thickness described above is an example only. The thickness of the frame 30*c* described above is not limited to this.

Hereinafter, description will be given with reference to FIG. 10

According to this embodiment, the lock portions 33 may have tapers in surfaces (33*e* and 33*f*), which constrain the side plates 32, in a mounding direction of the cartridge 30 (an arrow D direction of FIG. 4). The tapers are provided to easily constrain and lock the side plates 32 with the lock portions 33 even if the side plates 32 are deviated from desired positions with respect to the lock portions 33 when the cartridge 30 is mounted on the apparatus main body A.

As described above, according to this embodiment, the lock portions 33 have the tapers in the attached portions 33*a* and the engaging portions 33*b*. In other words, in the attached portions 33*a* and the engaging portions 33*b*, tapers 33*h* and 33*i* inclined in a direction away from the side plates 32 from an upstream side to a downstream side are provided in the mounting direction D (FIG. 10). When the thickness of the side plates 32 is about 0.6 mm, the length of l1 and l2 is about 1.5 mm. It should be noted that the thickness is only an example, so the thickness of the side plates 32 is not limited to this. Even if the side plates 32 and the lock portions 33 deviate from each other in a direction orthogonal to the mounting direction D when the cartridge 30 is mounted on the apparatus main body A, it is possible to surely guide the lock portions 33 to the side plates 32 using the tapers 33*h* and 33*i*. This is effective when the side plates 32 undergo a deflection and are deviated from the desired positions. It should be noted that an angle of inclination of the tapers 33*h* and 33*i* with respect to the side plates 32 is about 30° ($\alpha$1 and $\alpha$2 of FIG. 10).

As illustrated in FIGS. 4 and 9, a drum positioning portion 35 is provided in the apparatus main body A to position a part of the frame 30*c* of the cartridge 30 (near one end and the other end in the longitudinal direction of the photosensitive drum 2) with respect to the apparatus main body A. And, positioned portions 2*b* are provided at one end and the other end in the longitudinal direction of the cartridge 30 (the same as the longitudinal direction of the drum 2). The positioned portions 2*b* project outward from the sides 30*d* and 30*e* of the frame 30*c* and are provided on the same axis line as a drum axis 2*a* of the drum 2. The positioned portions 2*b* are positioned by the positioning portion 35 with the cartridge 30 mounted on the apparatus main body A (FIG. 4).

Moreover, as illustrated in FIGS. 3 and 4, lock levers 36 for fixing the cartridge 30 positioned and held in the apparatus main body A are provided in the apparatus main body A. As illustrated in FIG. 4, the vicinities of both of the ends in the longitudinal direction of the drum 2 are positioned by the positioning portion 35 and the lock portions 33 lock to the side plates 32. In this state, the levers 36 are rotated in an arrow C direction (FIG. 3). Consequently, the fixing of the cartridge 30 is completed with the cartridge 30 positioned and held in the apparatus main body A. It should be noted that the cartridge 30 in this state is urged by elastic means (not shown) provided in the apparatus main body A. Consequently, the cartridge 30 is surely positioned in the apparatus main body A. It should be noted that the operator manually operates the levers 36.

As described above, according to this embodiment, by mounting the cartridge 30 on the apparatus main body A, the lock portions 33 of the cartridge 30 lock both of the side plates 32. In this state, both of the side plates 32 are locked following the cartridge 30 at both of the ends in the longitudinal direction of the cartridge 30. In other words, the side plates 32 undergo a deflection and follow the cartridge 30. Consequently, the cartridge 30 mounted on the apparatus main body A regulates the distance between both of the side plates 32. At the same time, the cartridge 30 also functions as a reinforcing member for securing the rigidity of the apparatus main body A. Therefore, the thickness of the side plates 32 is reduced or the material of the side plates 32 is changed to a low-cost material. Consequently, even if a reduction in cost and a reduction in size of the apparatus main body A are realized, operability for mounting and detaching the cartridge 30 to and from the apparatus main body A is not deteriorated. Further, it is possible to accurately position and stably hold the photosensitive drum 2 (the cartridge 30) with respect to the apparatus main body A.

According to this embodiment described above, the apparatus main body A has the side plate 32 (the one end side main body frame) that supports the one end side in the longitudinal direction of the cartridge 30 mounted on the apparatus main body A (the longitudinal direction of the photosensitive drum 2) and undergoes a deflection in the longitudinal direction. And, the apparatus main body A also has the side plate 32 (the other end side main body frame) that supports the other end side in the longitudinal direction of the cartridge 30 mounted on the apparatus main body A and undergoes a deflection in the longitudinal direction. Under this condition, the cartridge 30 regulates the distance between the one end side plate 32 and the other end side plate 32 with the one end side in the longitudinal direction of the cartridge 30 supported by the side plate 32 and the other end side in the longitudinal direction thereof supported by the side plate 32.

Second Embodiment

Figure 5:
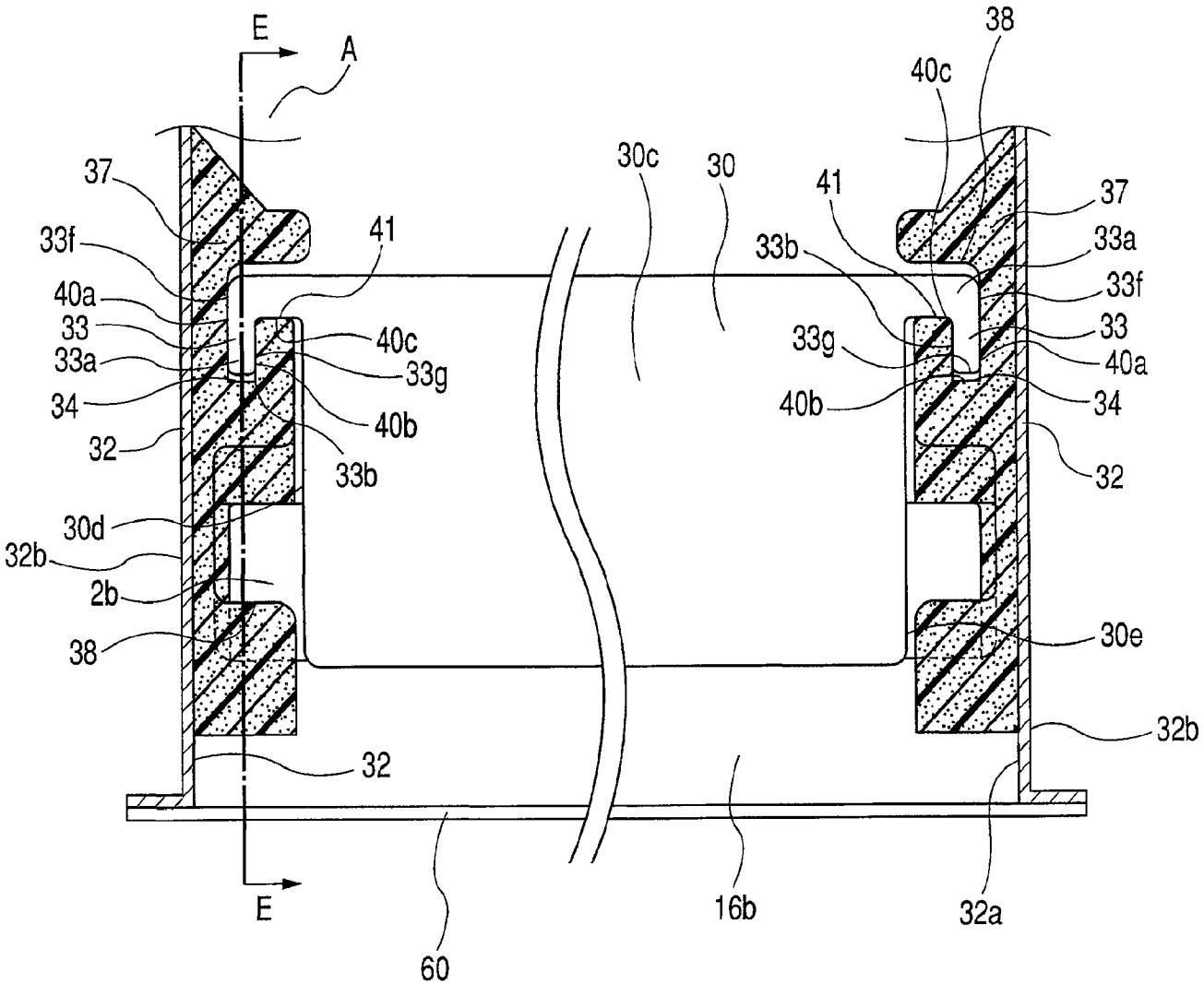
FIG. 5 is a front view of a state of a drum cartridge mounted on an apparatus main body according to a second embodiment of the present invention.
Figure 6:
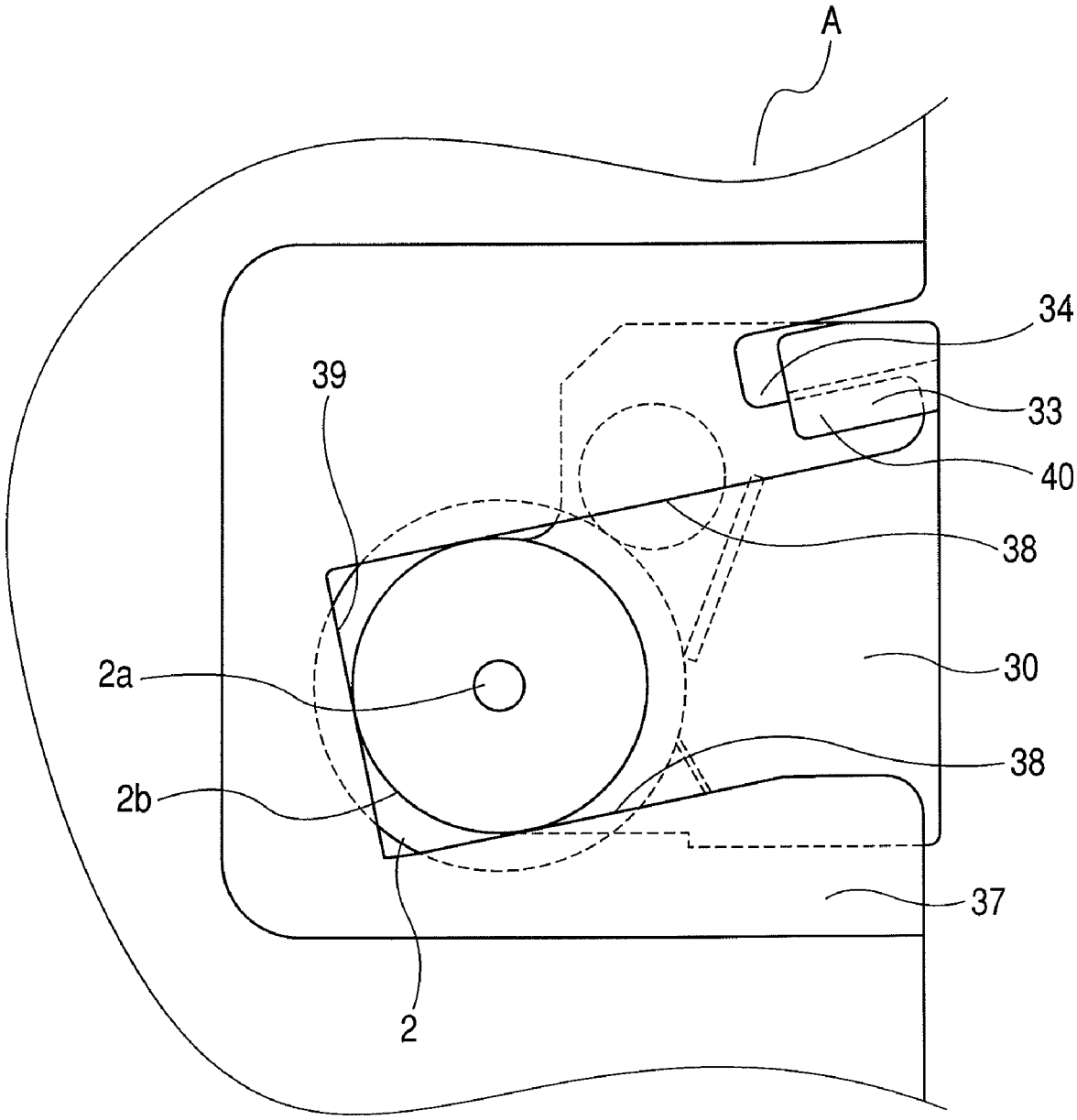
FIG. 6 is a sectional view of the state of the drum cartridge mounted on the apparatus main body according to the second embodiment.
Figure 11:
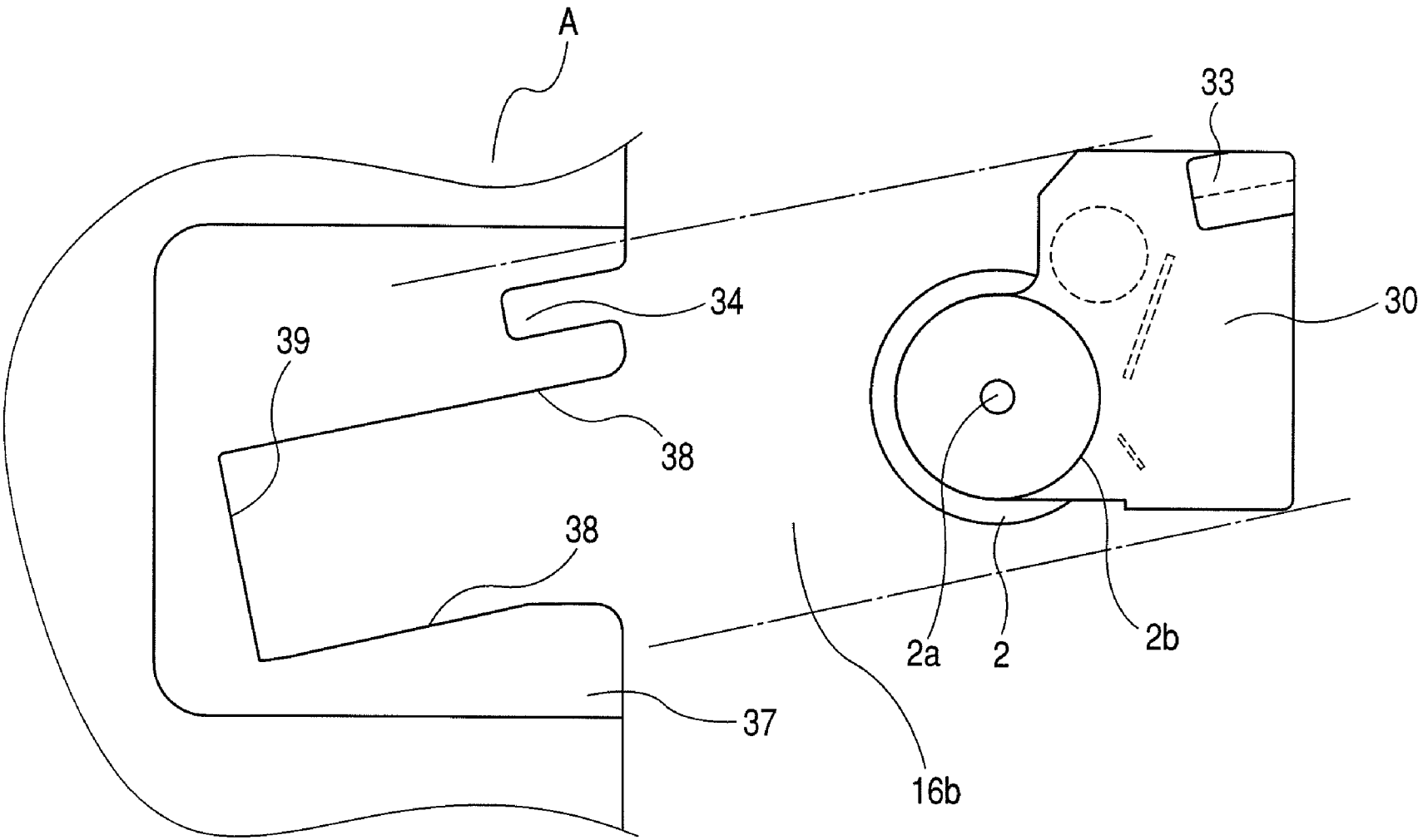
FIG. 11 is a sectional view of a state of mounting the drum cartridge on the apparatus main body according to the second embodiment.
Figure 12:
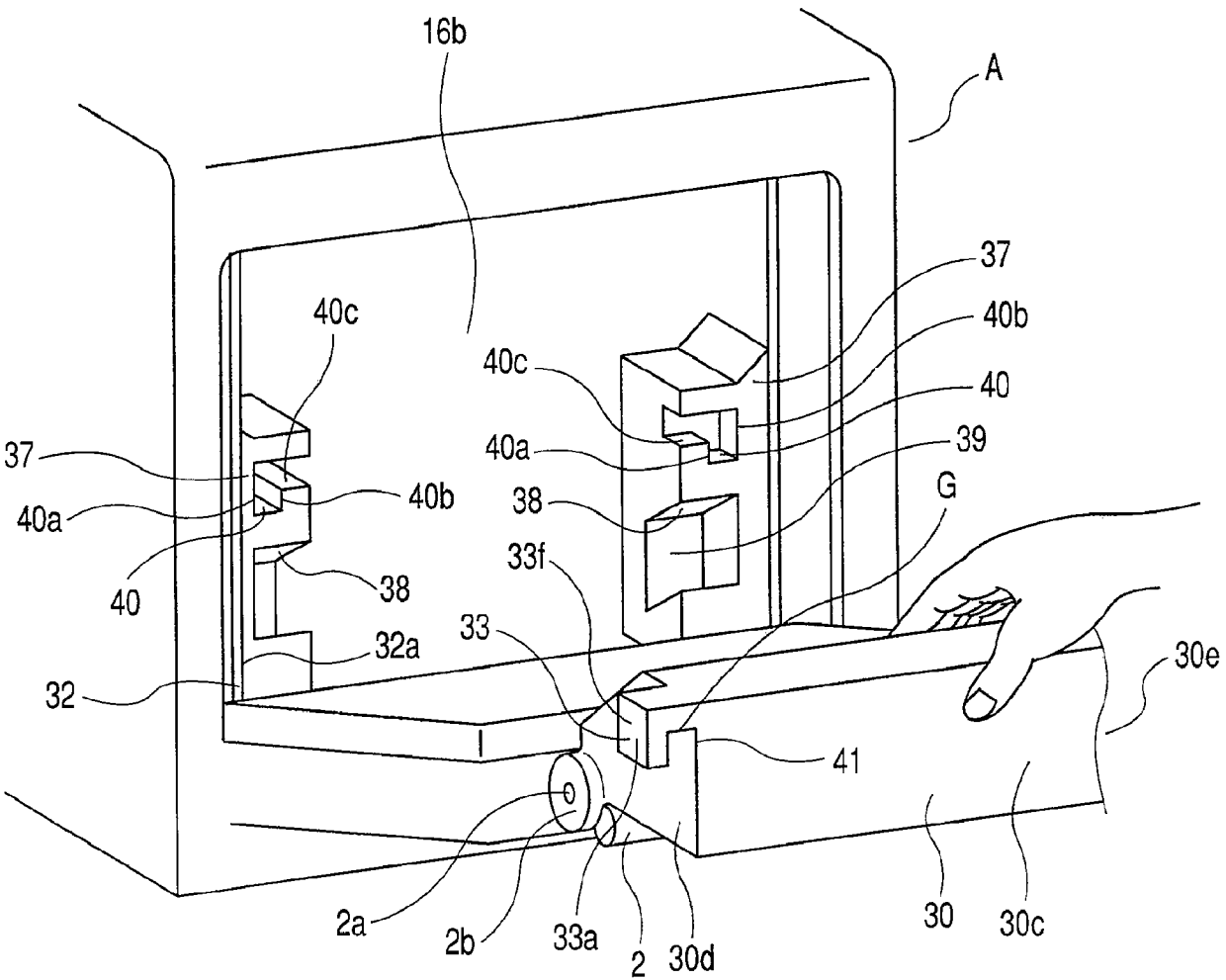
FIG. 12 is a perspective view of the state of mounting the drum cartridge on the apparatus main body according to the second embodiment.

A second embodiment of the present invention is described with reference to FIGS. 5 and 6. FIG. 5 is a front view illustrating a state of the cartridge 30 mounted on the apparatus main body A. FIG. 6 is a sectional view illustrating the state of the cartridge 30 mounted on the apparatus main body A and is a sectional view along E-E of FIG. 5. FIG. 11 is a side view illustrating a state of mounting the cartridge 30 to the apparatus main body A. FIG. 12 is a perspective view illustrating the state of mounting the cartridge 30 to the apparatus main body A.

In this embodiment, unlike the first embodiment, the cartridge 30 does not directly lock both of the side plates 32 but indirectly locks both of the side plates 32.

As illustrated in FIGS. 5 and 6, guide members 37 are integrally provided in both of the side plates (main body frames) 32 provided in the apparatus main body A, respectively. And, the guide members 37 are made of resin. The guide members 37 have guide surfaces 38 that guide the cartridge 30 when the cartridge 30 is mounted on the apparatus main body A and abutting surfaces 39 for regulating a position in an inserting direction of the cartridge 30. Further, the guide members 37 have cut-out portions 34 for constraining and locking the lock portions 33 of the cartridge 30. As illustrated in FIG. 5, the lock portions 33 of the cartridge 30 are bilaterally constrained and locked in the longitudinal direction by concave portions 40 of the guide members 37, respectively. In this state, both of the side plates 32 are locked following the cartridge 30 at both of the ends in the longitudinal direction of the cartridge 30. In other words, the side plates 32 undergo a deflection and follow the cartridge 30. Therefore, the cartridge 30 can guarantee the distance between both of the side plates 32.

As described above, according to this embodiment, the lock portions 33 are provided to project outward in the longitudinal direction from the sides 30*d* and 30*e*. And, the lock portions 33 have the attached portions 33*a* provided along the sides 30*d* and 30*e* (parallel to the sides 30*d* and 30*e*) with the gaps G therebetween. And, the lock portions 33 also have supported portions 41 that are provided to project in the longitudinal direction from the sides 30*d* and 30*e* and support the attached portions 33*a* on the sides 30*d* and 30*e*. A size of the gaps G and a size of the side plates 32 are as described above.

On the other hand, the guide members 37 have the concave portions 40 in the inner side portions 32*a* of the side plates 32. The concave portions 40 support the attached portions 33*a*. In other words, the attached portions 33*a* enter and fit in the concave portions 40. And, the attached portions 33*a* are supported by the concave portions 40. In other words, when the side plates 32 undergo a deflection to the inner side of the apparatus main body A, the outer side surfaces 33*f* of the attached portions 33*a* urge outer side inner surfaces 40*a* of the concave portions 40 to the outer side and the lock portions 33 lock to the side plates 32. And, when the side plates 32 undergo a deflection to the outer side of the apparatus main body A, the inner side surfaces 33*g* of the attached portions 33*a* urge inner side inner surfaces 40*b* of the concave portions 40 to the inner side and the lock portions 33 lock to the side plates 32. It should be noted that, in this state, wall portion distal ends 40*c* of the concave portions 40 support the supported portions 41.

According to this embodiment, the one end side lock portion 33 provided on one end side of the cartridge 30 is constrained and locked by the one end side guide member 37 provided in the one end side plate 32 in the longitudinal direction. And, the other end side lock portion 33 provided on the other end side of the cartridge 30 is constrained and locked by the other end side guide member 37 provided in the other end side plate 32 in the longitudinal direction.

In this way, the cartridge 30 corrects the deflection of the side plates 32 and maintains the distance between both of the side plates 32. In other words, the cartridge 30 corrects the deflection of the side plates 32 and regulates the distance between both of the side plates 32.

The other components in this embodiment are the same as those in the first embodiment. Therefore, description of the components is omitted.

As described above, according to this embodiment, by mounting the cartridge 30 to the apparatus main body A, the lock portions 33 of the cartridge 30 are locked by the guide members 37 provided in the apparatus main body A. In this case, the guide members 37 are locked following the cartridge 30 at both of the ends in the longitudinal direction of the cartridge 30. Consequently, the cartridge 30 mounted on the apparatus main body A regulates a distance between the guide members 37. At the same time, the cartridge 30 also functions as a reinforcing member for securing rigidity of the apparatus main body A. Therefore, the thickness of the side plates 32 is reduced or the material of the side plates 32 is changed to a low-cost material. Consequently, even if a reduction in cost and a reduction in size of the apparatus main body A are realized, operability for mounting and detaching the cartridge 30 to and from the apparatus main body A is not deteriorated. Further, it is possible to accurately position and stably hold the photosensitive drum 2 with respect to the apparatus main body A.

Third Embodiment

Figure 7:
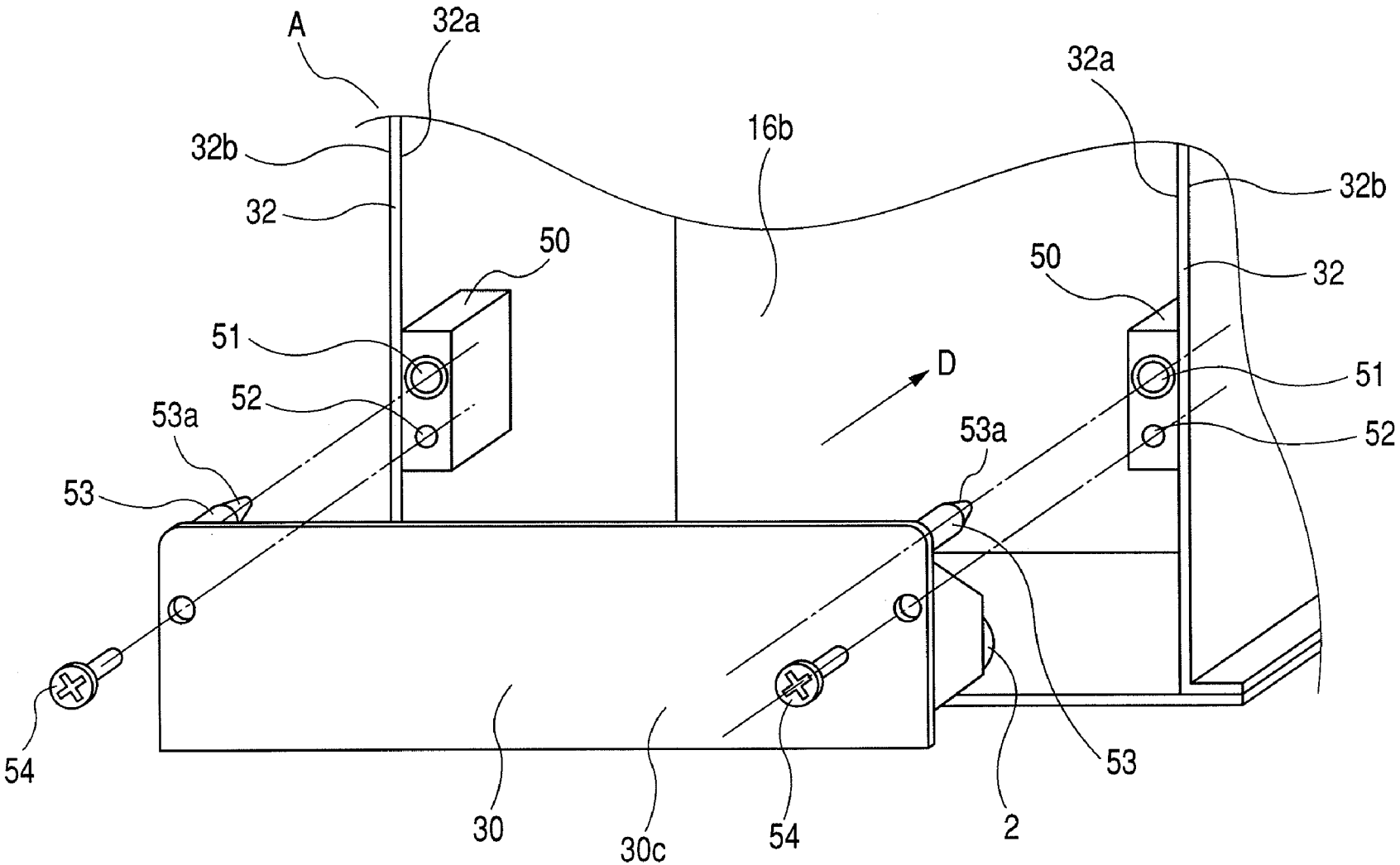
FIG. 7 is a perspective view of a state of a drum cartridge mounted on an apparatus main body according to a third embodiment of the present invention.
Figure 13:
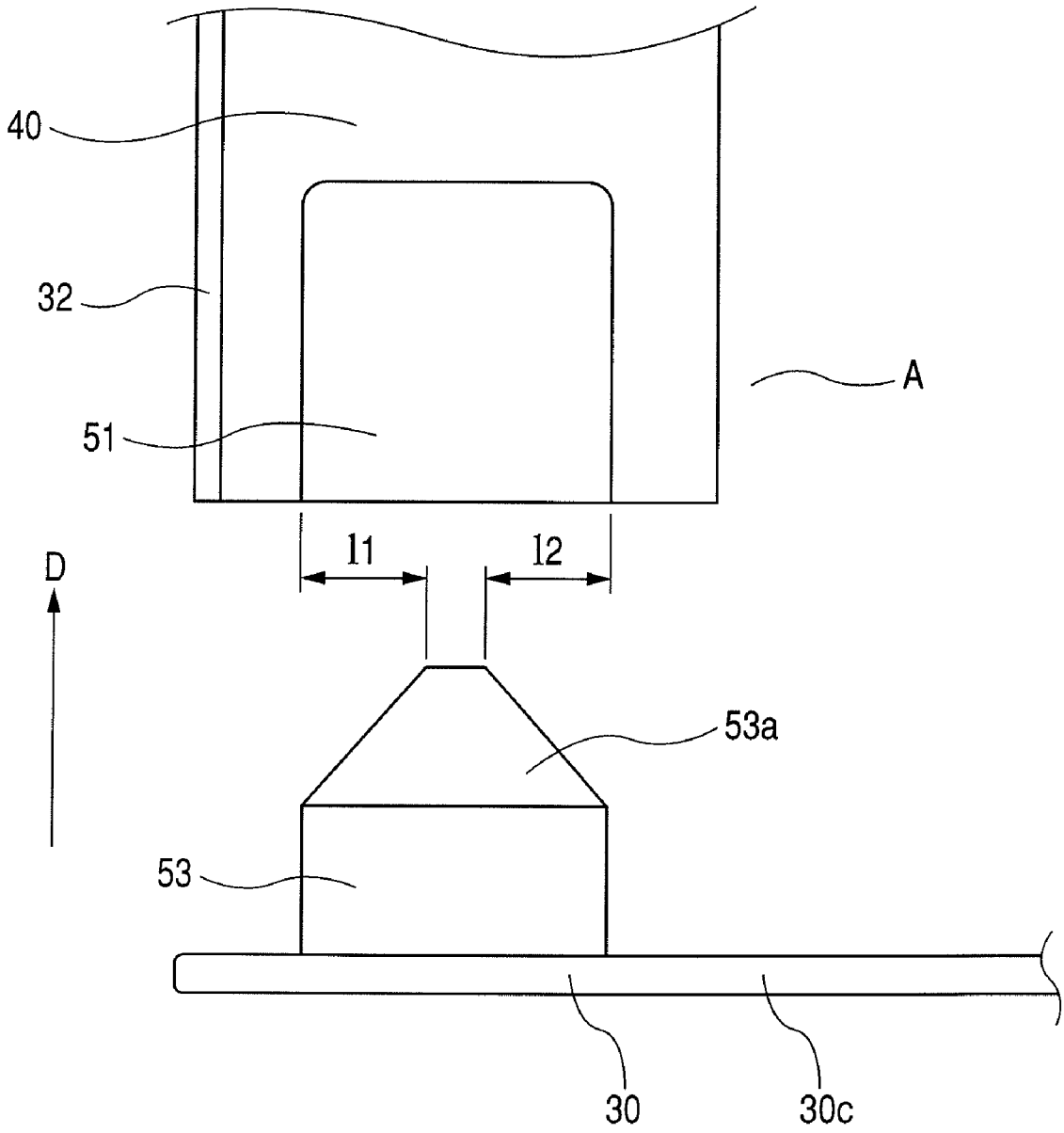
FIG. 13 is a partial enlarged view of the apparatus main body according to the third embodiment.

A third embodiment of the present invention is described with reference to FIG. 7. FIG. 7 is a perspective view illustrating a state of the cartridge 30 mounted on the apparatus main body A. FIG. 13 is a diagram illustrating a structure of lock portions according to this embodiment.

In this embodiment, as described in the second embodiment, the cartridge 30 is indirectly locked to both of the side plates 32.

As illustrated in FIG. 7, main body side positioning members 50 as guide members are integrally provided in both of the side plates 32, respectively. In the main body side positioning members 50, positioning holes (lock portions) 51 that fit with positioning pins (lock portions) 53 of the cartridge 30 and fixing screw holes 52 for fixing the cartridge 30 to the apparatus main body A with screws are provided. As illustrated in FIG. 7, the positioning pins 53 are inserted and fit in the positioning holes 51 of the positioning members 50 in a cartridge mounting direction orthogonal to the longitudinal direction, respectively. In this case, the side plates 32 are locked following the cartridge 30 at both of the ends in the longitudinal direction of the cartridge 30. Therefore, the cartridge 30 guarantees the distance between both of the side plates 32.

When the cartridge 30 mounted on the apparatus main body A is fixed to the apparatus main body A as described above, the screws 54 are fastened to the fixing screw holes 52 via the cartridge 30. Consequently, the fixing of the cartridge 30 is completed with the cartridge 30 positioned and held in the apparatus main body A. An enlarged view of tapers 53*a* is illustrated in FIG. 13. Also, in this embodiment, the tapers 53*a* are provided at distal ends of the positioning pins 53 in the mounting direction D. An effect of the tapers 53*a* is the same as an effect of tapers 33*h* and 33*i* (FIG. 10) described later. It should be noted that the length of l1 and l2 is about 1.5 mm.

The other components in this embodiment are the same as those in the embodiments described above. Therefore, description of the components is omitted.

As described above, according to this embodiment, by mounting the cartridge 30 to the apparatus main body A, the positioning portions 53 of the cartridge 30 fit in the positioning members 50 of the apparatus main body A. In this case, the positioning members 50 of the apparatus main body A fit following the cartridge 30 at both of the ends in the longitudinal direction of the cartridge 30.

In this embodiment, tapers illustrated in FIG. 13 may be provided.

Figure 10:
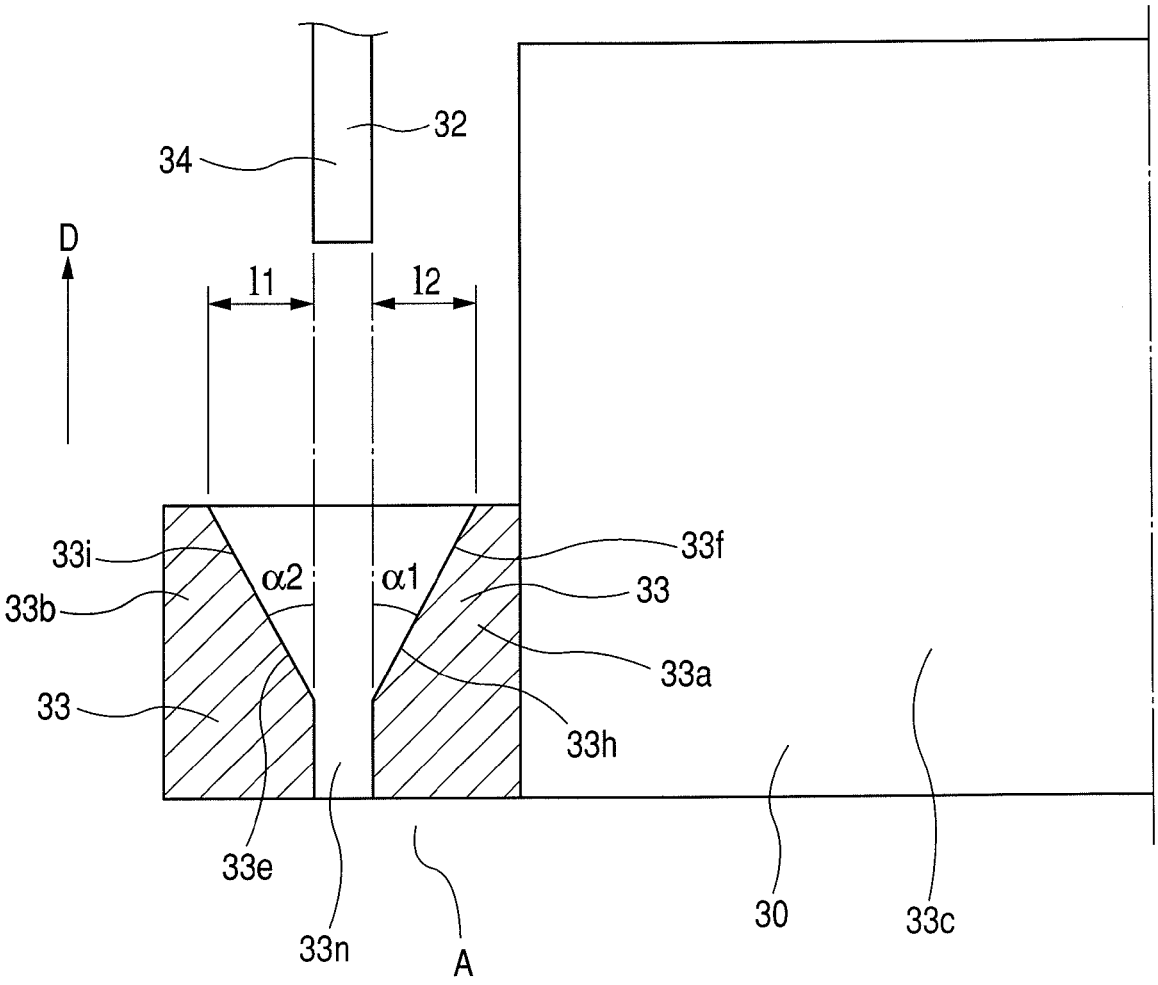
FIG. 10 is a partial enlarged view of the apparatus main body according to the first embodiment.

In other words, the tapers 33*h* and 33*i* inclined in a direction away from the side plates 32 from an upstream side to a downstream side in the mounting direction D are provided in the attached portions 33*a* and the engaging portions 33*b* (FIG. 10). When the thickness of the side plates 32 is about 0.6 mm, the length of l1 and l2 is about 1.5 mm. The thickness described above is only an example. The thickness of the side plates 32 is not limited to this. When the cartridge 30 is mounted on the apparatus main body A, even if the side plates 32 and the lock portions 33 deviate from each other in the direction orthogonal to the mounting direction D, it is possible to surely guide the lock portions 33 to the side plates 32 using the tapers 33*h* and 33*i*. This is effective when the side plates 32 undergo a deflection and are deviated from the desired positions. It should be noted that an angle of inclination of the tapers 33*h* and 33*i* with respect to the side plates 32 is about 30° ($\alpha 1$ and $\alpha 2$ of FIG. 10). Incidentally, a fitting portion 33*n* is guided by a tapered portion 33*h* and/or a tapered portion 33*i* so as to be fitted onto the side plate 32.

According to this embodiment, the one end side positioning pin (the one side lock portion) 53 provided on one end side of the cartridge 30 is inserted and fit in the main body side positioning member (the one side guide member) 50 (the positioning hole (the lock portion) 51), which is provided in the one end side plate 32, from the direction orthogonal to the longitudinal direction. And, the other end side positioning pin (the other end side lock portion) 53 provided on the other end side of the cartridge 30 is inserted and fit in the main body side positioning member (the other end side guide member) 50 (the positioning hole (the lock portion) 51), which is provided in the other end side plate 32, from the direction orthogonal to the longitudinal direction.

Consequently, the cartridge 30 mounted on the apparatus main body A regulates a distance between the positioning members 50 of the apparatus main body A. In other words, the cartridge 30 regulates the distance between the side plates 32. At the same time, the cartridge 30 also functions as a reinforcing member for securing rigidity of the apparatus main body A. Therefore, even if a reduction in cost and a reduction in size of the apparatus main body A are realized, operability for mounting and detaching the cartridge 30 to and from the apparatus main body A does not deteriorate. Further, it is possible to accurately position and stably hold the photosensitive drum 2 (cartridge 30) with respect to the apparatus main body A. Therefore, it is possible to prevent a mounting failure of the cartridge 3 and an image failure.

Other Embodiments

In the embodiments described above, the process cartridge is described as an example. However, the present invention is not limited to this. The same effect can be obtained when the present invention is applied to the developing cartridges 5*a* to 5*d* detachably mountable to the rotary 1. Therefore, the present invention can be applied to developing cartridges in the same manner.

For example, in the same manner as the lock portions 33 of the cartridge 30 according to the first embodiment described above, lock portions that lock to both side plates forming a frame of a rotary are provided at both ends in a longitudinal direction of developing cartridges. The lock portions are integrally provided in frames of the developing cartridges. And, by mounting the developing cartridges to an apparatus main body, both of the side plates of the rotary are bilaterally constrained in the longitudinal direction and locked. In this case, the rotary is locked following the developing cartridges at both of the ends in the longitudinal direction of the developing cartridges. Therefore, the developing cartridges can guarantee the distance between both of the side plates of the rotary.

In the same manner as the guide members 37 of the apparatus main body A in the second embodiment described above, guide members are integrally provided in both side plates forming a frame of a rotary, respectively. The guide members are made of resin and have guide surfaces that guide developing cartridges when the developing cartridges are mounted on the rotary and abutting surfaces for regulating positions in an inserting direction of the developing cartridges. In addition, the guide members have cut-out portions for constraining and locking lock portions of the developing cartridges. The lock portions of the developing cartridges are bilaterally constrained and locked in the longitudinal direction by the cut-out portions of the guide members, respectively. In this case, the rotary is locked following the developing cartridges at both of the ends in the longitudinal direction of the developing cartridges. Therefore, the developing cartridges guarantee the distance between both of the side plates of the rotary.

In the same manner as the main body side positioning members 50 of the apparatus main body A in the third embodiment described above, positioning members (guide members) are integrally provided in both side plates forming a frame of a rotary, respectively. The positioning members have positioning holes (lock portions) that fit with positioning pins (lock portions) of developing cartridges and fixing screw holes for fixing the developing cartridges to an apparatus main body A with screws. The positioning pins of the developing cartridges are inserted and fit in the positioning holes of the positioning member in a cartridge mounting direction orthogonal to the longitudinal direction, respectively. In this case, the apparatus main body A (both of the side plates of the rotary) is locked following the developing cartridges at both ends in the longitudinal direction of the developing cartridges. Therefore, the developing cartridges guarantee the distance between both of the side plates of the rotary.

As described above, when the present invention is applied to the developing cartridges detachably mountable to the rotary of the image forming apparatus main body, it is possible to obtain an effect same as the effect of the process cartridge described above.

In the embodiments described above, the developing cartridges detachably mountable to the rotary of the apparatus main body are described as an example. However, the present invention is not limited to this. For example, when the present invention is applied to developing cartridges directly detachably mountable to an apparatus main body of an image forming apparatus that does not have the rotary, it is possible to obtain the same effect.

In the embodiments described above, the configuration of using the four developing cartridges is described as an example. However, the number of developing cartridges in use is not limited to this and may be appropriately set as required.

In the embodiments described above, as the process cartridge detachably mountable to the image forming apparatus main body, the cartridge integrally including the photosensitive drum, the charging means as a process member that acts on the photosensitive drum, and the cleaning means is described as an example. However, the process cartridge is not limited to this configuration. For example, the process cartridge may be a cartridge that integrally includes any one of charging means (a process member), developing means (a process member), and cleaning means (a process member), besides a photosensitive drum.

In the embodiments described above, the configuration of using one process cartridge is described as an example. However, the number of process cartridges in use is not limited to this and may be appropriately set as required.

As described above, the present invention can be applied to the process cartridge which integrally includes the photosensitive drum 2 and the process member, which acts on the photosensitive drum 2 and which is detachably mountable to the main body of the electrophotographic image forming apparatus. Further, the present invention can be applied to the developing cartridge that integrally includes the developing rollers 25 for developing electrostatic latent images formed on the photosensitive drum 2 and the developer containing portions which contain developers used for developing the electrostatic latent images by the developing rollers 25 and which is detachably mountable to the apparatus main body A.

In the embodiments described above, the printer is described as an example of the electrophotographic image forming apparatus. However, the present invention is not limited to this. For example, the electrophotographic image forming apparatus may be other electrophotographic image forming apparatuses such as a copying machine and a facsimile machine or may be other electrophotographic image forming apparatuses such as a multifunction peripheral in which functions of the copying machine, the facsimile machine, and the like are combined. In the embodiments described above, the electrophotographic image forming apparatus in which the intermediate transfer member is used is described as an example. However, the present invention is not limited to this. For example, the electrophotographic image forming apparatus may be an electrophotographic image forming apparatus in which a recording medium carrying member is used. In this electrophotographic image forming apparatus, developer images of respective colors are sequentially superimposed one on top of another and transferred onto a recording medium carried by the recording medium carrying member. It is possible to obtain the same effect by applying the present invention to such an image forming apparatus.

According to the embodiments described above, movement of the cartridges (developing cartridges 5, process cartridge 30) and the one end side plate 32 in the longitudinal direction of the cartridges are regulated. Movement of the cartridges 5 and 30 and the other end side plate 32 in the longitudinal direction are regulated. In this state, the cartridges 5 and 30 are supported by the one end side plate 32 and the other end side plate 32. Consequently, it is possible to obtain the effect described above.

According to the embodiments described above, by mounting the cartridge to the apparatus main body, the lock portions of the cartridge lock the apparatus main body. In this case, the apparatus main body is locked following the cartridge at both ends in the longitudinal direction of the cartridge. Consequently, the cartridge regulates the distance in the apparatus main body in which the cartridge mounted on the apparatus main body is interposed. At the same time, the cartridge also functions as a reinforcing member that secures rigidity of the apparatus main body. Therefore, even if a reduction in cost and a reduction in size of the apparatus main body are realized, operability for mounting and detaching the cartridge to and from the apparatus main body does not deteriorate. Further, it is possible, for example, to accurately position and stably hold the electrophotographic photosensitive drum with respect to the apparatus main body.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-128987, filed May 15, 2007, and Japanese Patent Application No. 2008-112003, filed Apr. 23, 2008, which are hereby incorporated by reference herein in their entirety.

What is claimed is:

1. An electrophotographic image forming apparatus that is detachably mounted with a cartridge and forms an image on a recording medium, the electrophotographic image forming apparatus comprising:

a first end side main body frame that supports one end side of the cartridge in a longitudinal direction thereof mounted on the electrophotographic image forming apparatus, the first end side main body frame undergoing a deflection in the longitudinal direction;

a second end side main body frame that supports the other end side of the cartridge in the longitudinal direction thereof mounted on the electrophotographic image forming apparatus, the second end side main body frame undergoing a deflection in the longitudinal direction; and the cartridge, which regulates the distance between the first end side main body frame and the second end side main body frame with the one end side in the longitudinal direction thereof supported by the first end side main body frame and the other end side in the longitudinal direction thereof supported by the second end side main body frame.

2. An electrophotographic image forming apparatus according to claim 1, wherein the cartridge and the first end side main body frame are in a state where movements thereof in the longitudinal direction of the cartridge are regulated, the cartridge and the second end side main body frame are in a state where movements thereof in the longitudinal direction of the cartridge are regulated, and the cartridge is supported by the first end side main body frame and the second end side main body frame.

3. An electrophotographic image forming apparatus according to claim 2, wherein a first end side lock portion provided on the one end side of the cartridge bilaterally constrains and locks a side plate serving as the first end side main body frame in the longitudinal direction of the cartridge, and a second end side lock portion provided on the other end side of the cartridge bilaterally constrains and locks a side plate serving as the second end side main body frame in the longitudinal direction of the cartridge.

4. An electrophotographic image forming apparatus according to claim 2, wherein a first end side lock portion provided on the one end side of the cartridge is constrained and locked in the longitudinal direction of the cartridge by a first end side guide member provided in a side plate serving as the first end side main body frame, and a second end side lock portion provided on the other end side of the cartridge is constrained and locked in the longitudinal direction of the cartridge by a second end side guide member provided in a side plate serving as the second end side main body frame.

5. An electrophotographic image forming apparatus according to claim 2, wherein a first end side lock portion provided on the one end side of the cartridge is inserted and fitted into a first end side guide member provided in a side plate serving as the first end side main body frame in a direction orthogonal to the longitudinal direction of the cartridge, and a second end side lock portion provided on the other end side of the cartridge is inserted and fitted into a second end side guide member provided in a side plate serving as the second end side main body frame in the direction orthogonal to the longitudinal direction of the cartridge.

6. An electrophotographic image forming apparatus according to claim 1, wherein the cartridge is one of:

a process cartridge that integrally comprises an electrophotographic photosensitive drum and a process member which acts on the electrophotographic photosensitive drum, the process cartridge being detachably mountable to a main body of the electrophotographic image forming apparatus; and a developing cartridge that integrally comprises a developing roller that develops an electrostatic latent image formed on the electrophotographic photosensitive drum and a developer containing portion which contains a developer used by the developing roller that develops the electrostatic latent image, the developing cartridge being detachably mountable to the main body.

7. A cartridge detachably mountable to a main body of an electrophotographic image forming apparatus to which said cartridge is detachably mountable and which forms an image on a recording medium, the electrophotographic image forming apparatus including: a first end side main body frame that supports one end side of said cartridge in a longitudinal direction thereof mounted on the main body, the first end side main body frame undergoing a deflection in the longitudinal direction of said cartridge; and a second end side main body frame that supports the other end side of the cartridge in the longitudinal direction thereof mounted on the main body, the second end side main body frame undergoing a deflection in the longitudinal direction, said cartridge comprising:

a frame;

a first end side lock portion provided on one end side of said cartridge in a longitudinal direction of said frame; and a second end side lock portion provided on the other end side of said cartridge in the longitudinal direction of said frame, wherein said cartridge regulates the distance between the first end side main body frame and the second end side main body frame with the one end side of said cartridge in the longitudinal direction thereof supported by the first end side main body frame and the other end side of said cartridge in the longitudinal direction thereof supported by the second end side main body frame.

8. A cartridge according to claim 7, wherein said cartridge and the first end side main body frame are in a state where movements thereof in the longitudinal direction of said cartridge are regulated, said cartridge and the second end side main body frame are in a state where movements thereof in the longitudinal direction of said cartridge are regulated, and said cartridge is supported by the first end side main body frame and the second end side main body frame.

9. A cartridge according to claim 8, wherein said first end side lock portion bilaterally constrains and locks a side plate serving as the first end side main body frame in the longitudinal direction of said cartridge, and the second end side lock portion bilaterally constrains and locks a side plate serving as the second end side main body frame in the longitudinal direction of said cartridge.

10. A cartridge according to claim 8, wherein said first end side lock portion is constrained and locked in the longitudinal direction of said cartridge by a first end side guide member provided in a side plate serving as the first end side main body frame; and said second end side lock portion is constrained and locked in the longitudinal direction of said cartridge by a second end side guide member provided in a side plate serving as the second end side main body frame.

11. A cartridge according to claim 8, wherein said first end side lock portion is inserted and fitted into a first end side guide member provided in a side plate serving as the first end side main body frame in a direction orthogonal to the longitudinal direction of said cartridge; and said second end side lock portion is inserted and fitted into the second end side guide member provided in a side plate serving as the second end side main body frame in the direction orthogonal to the longitudinal direction of said cartridge.

12. A cartridge according to claim 7, wherein said cartridge is one of:

a process cartridge that integrally comprises an electrophotographic photosensitive drum and a process member which acts on said electrophotographic photosensitive drum, said process cartridge being detachably mountable to the main body of the electrophotographic image forming apparatus, and a developing cartridge that integrally comprises a developing roller that develops an electrostatic latent image formed on said electrophotographic photosensitive drum and a developer containing portion which contains a developer used by said developing roller that develops the electrostatic latent image, said developing cartridge being detachably mountable to the main body.

* * * * *